US005713091A

United States Patent [19]

Houchin

[11] Patent Number: 5,713,091

[45] Date of Patent: Feb. 3, 1998

[54] PORTABLE BED RAISER

[76] Inventor: Harold E. Houchin, 581 Teryl Rd., Apartment #5, Naples, Fla. 33962

[21] Appl. No.: 556,456

[22] Filed: Nov. 15, 1995

[51] Int. Cl.[6] ..... A47C 21/00

[52] U.S. Cl. ..... 5/660; 5/610; 5/509.1

[58] Field of Search ..... 5/610, 634, 509.1, 5/660; 257/7 A, 7 B, 7 C

[56] References Cited

U.S. PATENT DOCUMENTS

| | | | |
|---|---|---|---|
| 3,310,289 | 3/1967 | Burke | 5/509.1 |
| 4,856,129 | 8/1989 | Butler | 5/610 |
| 4,989,281 | 2/1991 | Christensen | 5/660 |

FOREIGN PATENT DOCUMENTS

| | | | |
|---|---|---|---|
| 151763 | 12/1937 | Austria | 5/509.1 |
| 30083 | 1/1926 | France | 5/634 |
| 377481 | 6/1964 | Sweden | 5/610 |

*Primary Examiner*—Michael F. Trettel
*Attorney, Agent, or Firm*—Standley & Gilcrest

[57] ABSTRACT

An adjustable and portable bed raiser which raises the head of a bed to an incline so as to reduce gastroesophageal reflux, and thus heartburn, while a user is sleeping. The adjustable bed raiser is separate from the bed intended to be lifted and is comprised of a rotary motor, a mattress support, a control means electrically connected to the motor, a means for lifting the mattress support, and thus the bed to an inclined position.

8 Claims, 4 Drawing Sheets

PORTABLE BED RAISER

BACKGROUND OF THE INVENTION

The present invention relates generally to an apparatus for adjusting the position of a bed, more particularly, to a portable and economical apparatus for raising the bed to an incline position.

Gastroesophageal Reflux Disease (GERD) refers to symptoms or tissue damage that result from gastroesophagea/reflux. Reflux generally refers to the repulsion of the stomach contents, most often acids, into the esophagus. The tissue of the esophagus is damaged as it is very sensitive to the reflux as the esophagus does not contain the special lining of the stomach which protects against the harmful gastric acids. Heartburn is the most common and specific symptom of GERD. In some patients, chest pain or respiratory symptoms may be the only presenting signs. Gastroesophageal Reflux Disease (GERD) is a common problem in the general population. Studies have shown that there is a prevalence of GERD in the elderly.

As discussed, GERD often results from an increased frequency or duration of exposure of the distal esophagus to gastric contents. Impaired esophageal clearance leads to this prolonged exposure to refluxate acid. Malfunctioning of the Lower Esophageal Sphincter(LES), a "valve" which keeps the gastric contents from entering into the esophagus, is a common cause of reflux, and most often to GERD.

Additionally, elderly people with a condition known as hiatal hernias are more prone to GERD. Hiatal hernia refers to a condition where part of the stomach moves past the LES and into the esophagus. This intrusion often disrupts the proper functioning of the LES and often leads to reflux. In other words hiatal hernias can impair esophageal clearance by sensing as an acid trap. Additionally, it has been shown that horizontal body position may impair esophageal clearance, particularly in GERD patients. Thus, even minor mounts of reflux occurring at night, during sleep, may result in significant esophageal damage.

Treatment of GERD involves medical therapy in the majority of instances, with surgical treatment applied in some circumtances. Initial medical treatment and management often results in symptomatic improvement, however elderly patients with complications of reflux or refractory symptoms represent a medical dilemma. Elderly patients often do not respond well to pharmacologic therapy and the fear of morbidity and mortality of surgical treatment in the elderly often leads to denial or delay in surgical referral. Accordingly, there is a need for an alternative treatment to gastroesophageal reflux for the elderly.

Reflux, especially with hiatal hernia patients, can be significantly reduced by inclining the bed while sleeping. This non-surgical treatment of GERD represents an effective alternative treatment which is very appealing to the elderly who suffer from this problem. The present invention elevates the head of a bed to an inclined position, which effectively improves esophageal acid clearance of a sleeping user and thus reduces the harmful effects of reflux.

Adjustable beds have long been used in hospitals, and other health care facilities in facilitating care and comfort for the sick and elderly. Most of the prior art deals with adjustable beds which lift the bed in a level and vertical direction. This feature allows the doctor to raise the bed lower or higher to facilitate examination of the patient. Lowering the bed vertically also allows the patient to more easily get up from the bed. The prior art also teaches adjustable beds which raise the ends of the bed in a hinged fashion. This allows, for example, the patient to be raised to a sitting position if the head portion of the bed is raised and also may allow the patient's legs to be raised if the feet portion of the bed is raised. The prior art devices teach accomplishing the adjusting features by mechanical or motor driven mechanism which are either a part of the bed frame, mattress, or both. For example see U.S. Pat. Nos. 4,183,109, 4,227,269, 4,545,084, and 5,020,169. All of the above-mentioned prior art deals with beds which are adjustable to positions that enable a doctor to more effectively treat the patient, or beds which adjust to a position, such as a sitting position, for the patient's comfort and convenience. To applicant's howledge, nothing in the prior art teaches the use of a device which may be applied to practically any existing bed frame and which elevates the head of the bed so that the bed resides in an inclined position, while the user is sleeping, for the purpose of improving esophageal acid clearance and thus reducing the harmful effects of reflux in elderly people (especially elderly people with hiatal hernias who are more prone to

SUMMARY OF THE INVENTION

It therefore the object of this invention to provide an adjustable bed raiser which will lift the head of a bed to an inclined position.

It is therefore another object of this invention to provide an economical and portable bed raiser which will lift the head of a bed to an inclined position.

It is therefore another object of this invention to provide an economical and portable bed raiser which will lift the head of a bed to an inclined position for the purpose of improving esophageal acid clearance in the sleeping user and thus reducing the harmful effects of reflux.

These and other objects of the invention, as will be apparent herein, are accomplished by the portable bed raiser of the present invention comprising: a control means; a motor, electrically connected to the control means; a mattress support, having a first and second end; a means for raising and lifting the mattress support; and a power transmission means, where the power transmission means transfers the power created by the motor to the means for raising and lifting the mattress support in response to the control means.

It is also preferred that the bed raiser apparatus further comprise: a base; and a pair of adjustable mattress support reinforcements attached to the base the mattress support.

It is also preferred that the mattress support of the bed raiser apparatus be adjustable to the size of the bed intended to be raised and lowered.

It is preferred that the bed raiser apparatus timber comprise: a first adjustable support which is extractable from the first end of the mattress support; a second adjustable support which is extractable from the second end of the mattress support; a first end clamp mounted on the first adjustable support; and a second end clamp mounted on the second adjustable support.

It is also preferred that the bed raiser apparatus lift the bed from about 0 to 10 inches above its normally flat position.

It is also preferred that said control means of the bed raiser apparatus be a switch and circuit arrangement for selectively activating the motor and controlling the direction of rotation thereof.

It is also preferred that the motor of the bed raiser apparatus be an electric rotary motor operable in either rotational direction and which further comprises a first output shaft on one side of the motor; and a second output shaft on the opposite side of the motor.

It is also preferred that the power transmission means of the bed raiser apparatus comprise: a first threaded screw connected to the first output shaft; and a second threaded screw connected to the second output shaft.

It is preferred that means for raising and lifting the mattress support of the bed raiser apparatus comprise: a first threaded sleeve member threadedly connected to the first threaded screw; a second threaded sleeve member threadedly connected to the second thread screw; a first upper arm, with a first and second end, where the first end is hinged to the first threaded sleeve member and the second end is connected to the mattress support; a second upper arm, with a first and second end, where the first end is hinged to the second threaded sleeve member and the second end is connected to said mattress support; a first lower arm, with a first and second end, where the first end is hinged to the first threaded sleeve member and the second end is connected to the base; and a second lower arm, with a first and second end, where said first end is hinged to the second threaded sleeve member and the second end is connected to the base. The first and second threaded screws rotate in one direction in response to the controller, thereby causing the first and second threaded sleeve members to move away from the motor causing the first and second lower and upper arms to extend and the mattress support to rise. The first and second threaded screws rotate in a second direction in response to the controller, thereby causing the first and second threaded sleeve members to move toward the motor causing the first and second lower and upper arms to retract and the mattress support to lower.

It is preferred that the bed raiser apparatus further comprise a means for automatically and positively looking the motor in place upon motor deactivation for retaining the mattress support in a selected position.

It is preferred that the bed raiser apparatus elevate the head of the bed so that the bed resides in an inclined position, while the user is sleeping, for the purpose of improving esophageal acid clearance and thus reducing the harmful effects of reflux in elderly people.

BRIEF DESCRIPTION OF THE DRAWINGS

Novel features and advantages of the present invention in addition to those mentioned above will become apparent to those skilled in the art from a reading of the following detailed description in conjunction with the accompanying drawings wherein similar reference characters refer to similar parts and in which.

DETAILED DESCRIPTION OF THE PREFERRED EMBODIMENTS

The preferred apparatus herein described is not intended to be exhaustive or to limit the invention to the precise forms disclosed. They are chosen and described to explain the principles of the invention, and the application of the method to practical uses, so that others skilled in the art may practice the invention.

Figure 1:
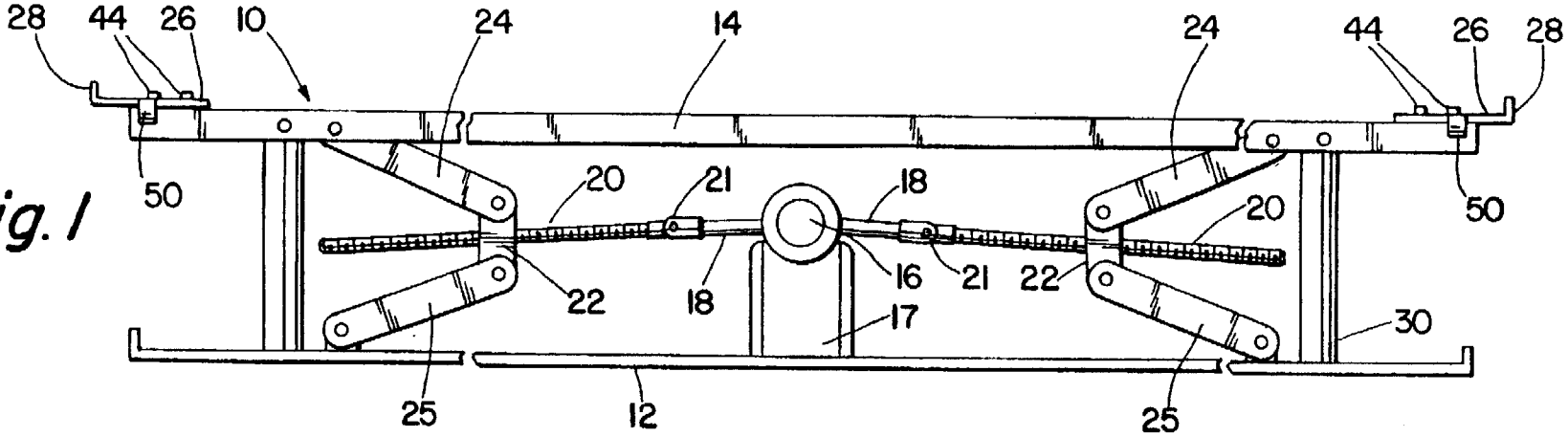
FIG. 1 is a front elevation view of a preferred embodiment of the portable bed raiser of the present invention in the down position.

Referring in more detail to the drawings and particularly FIG. 1, a preferred embodiment is shown with the portable bed raiser 10 depicted in the down position. The portable bed raiser 10 is comprised of a base or frame portion 12, a mattress support section 14, a motor 16, a motor base 17 a pair of output shafts 18, a pair of threaded screws 20, a pair of universal joints 21, a pair of threaded sleeve members 22, a pair of hinges 23 (not shown in FIG. 1), a pair of hinged upper arms 24, a pair of hinged lower arms 25, and a pair of extensions 26.

The portable bed raiser 10 is placed under the head of the bed intended to be raised. The head of the bed is placed onto the mattress support 14. The pair of extensions 26 can be extracted or retracted from the ends of the mattress support 14 to account for variations in the bed intended to be raised. The mattress support 14 may also be made in standard widths to fit single, full, queen, and king size beds.

Figure 2:
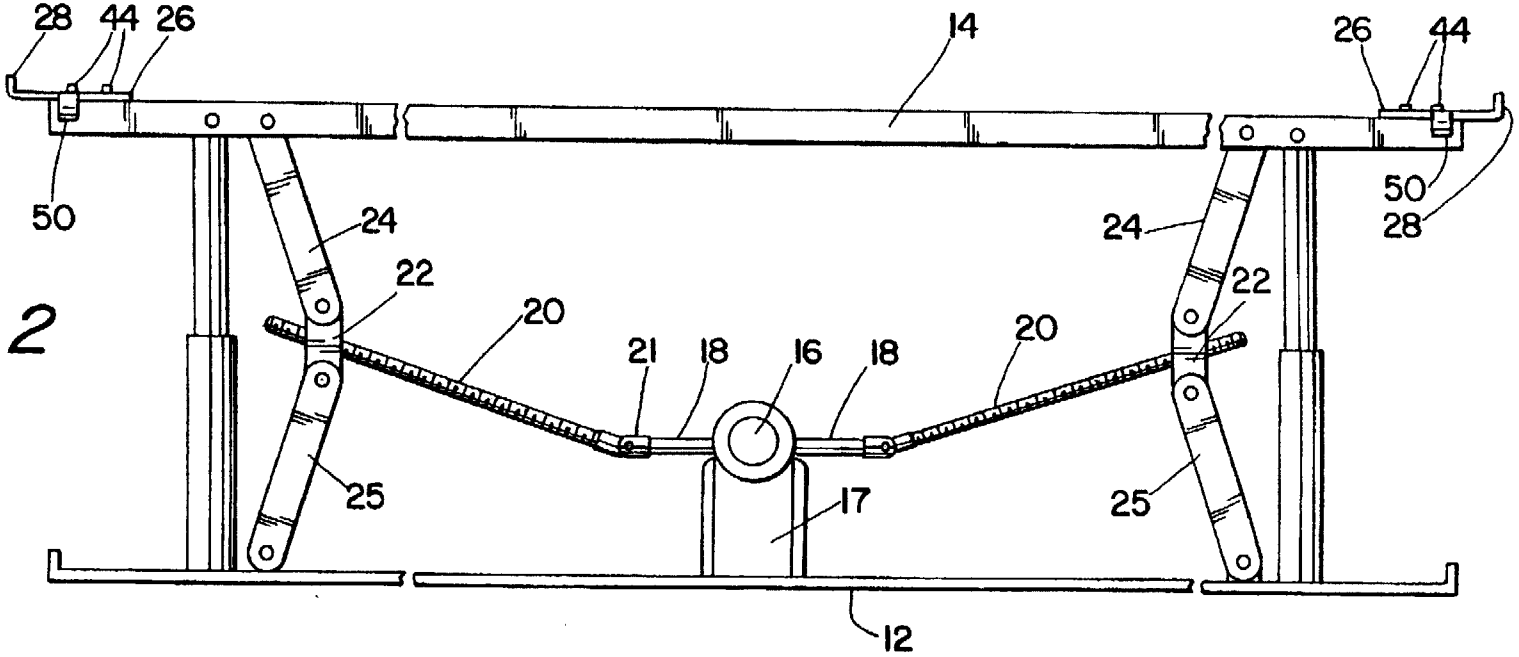
FIG. 2 is a front elevation view of the portable bed raiser of FIG. 1 in the up position.

The electric rotary motor 16 is electrically connected to a switch which is connected to a power source, such as a standard wall outlet, for selectively activating the motor 16 and controlling the direction of the rotation thereof. Upon activating the motor 16 and directing the motor 16 to rotate in one direction (counterclockwise or clockwise depending on the threading of the screws 20) by an electronic control means, the head of the bed is raised to an incline position. FIG. 2 depicts the bed raiser in this "up" position. Upon directing the motor 16 to rotate in the other direction, the head of the bed is lowered.

The switch and circuit arrangement can be accomplished by many different ways known to those of ordinary skill in the art. In one preferred embodiment the switch is a toggle switch. A user may switch the toggle switch in one direction causing the motor 16 to rotate the output shafts 18 in one direction causing the bed to rise. By switching the switch to the opposite direction, the motor 16 will rotate the output shafts 18 in the opposite direction causing the bed to lower. In the preferred embodiment, the switch and circuit arrangement is comprised of limiting switches which prevents the motor 16 from raising the bed above a predetermined position and from lowering the bed below a predetermined position.

Figure 3:
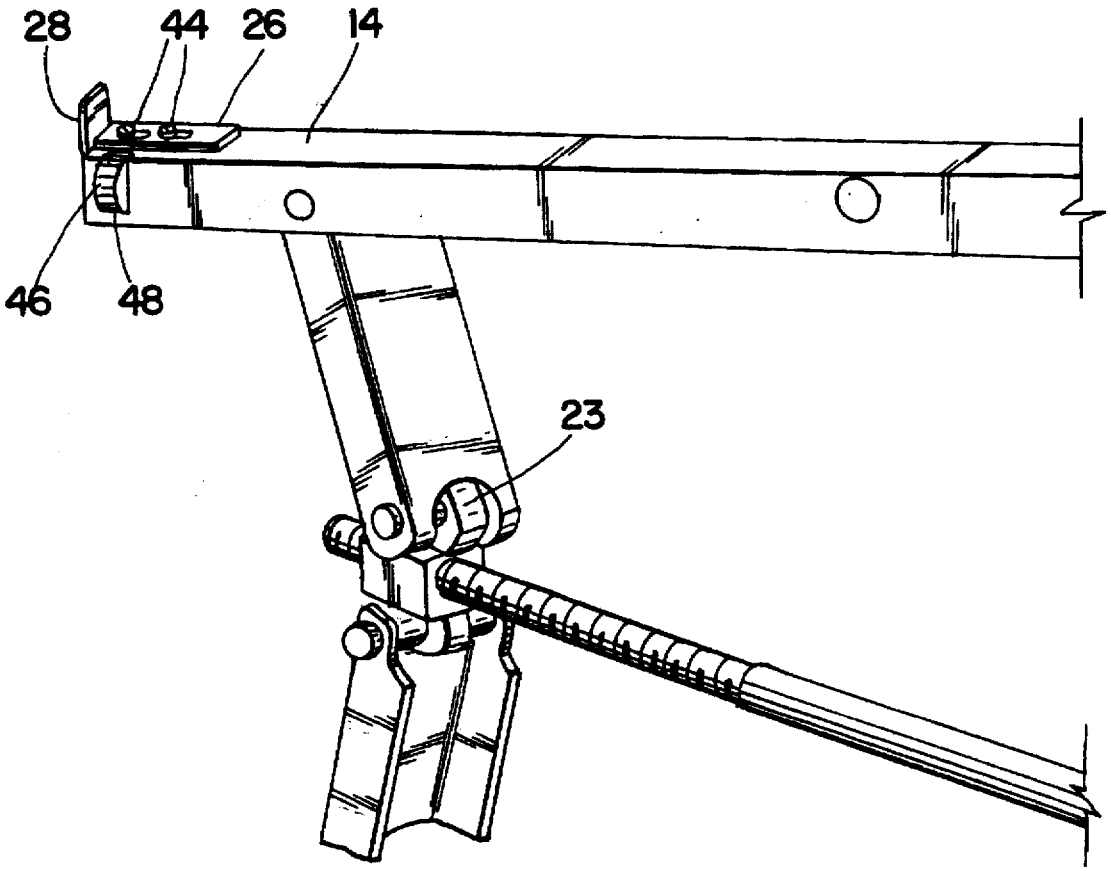
FIG. 3 is a partial perspective, view of the threaded joint of the portable bed raiser of FIG. 1.

FIG. 3 better illustrates the operation of the invention. As illustrated, the motor is a right angle rotary motor 16. Upon electrically directing the bed raiser 10 to raise the bed by way of the switching means, the motor 16 will be activated causing rotation of the output shafts 18 and the attached threaded screws 20 in the appropriate direction. The threaded sleeves 22, which ride along the threaded screws 20, move away from the motor 16 due to the rotation of the screws 20. As the threaded sleeves 22 move away from the motor 16, as depicted by the arrow in FIG. 3, the arms 24, 25 which are pivotally hinged to the threaded sleeves 22, extend or straighten causing the mattress support 14 to rise.

The universal joints 21, which are connected to the output shafts 18, allow the screws 20 to bend as the sleeves 22 move along the screws 20. As illustrated by the drawings, the screws 20 are in different positions when the apparatus is in the down position when compared to the up position. The arms 24, 25 at a fully extended position should elevate the head of the bed resting on the mattress support 14 approximately 6 inches from its normal position. If desired, the bed raiser can be assembled to raise the bed higher than 6 inches.

Upon electrically directing the bed raiser 10 to lower the bed by way of the switching means, the motor will be activated causing rotation of the output shafts 18 and the attached threaded screws 20 in the opposite direction. The threaded sleeves 22, which ride along the threaded screws 20, move toward the motor 16 due to the rotation of the screws 20. As the threaded sleeves 22 move toward the motor 16, the arms 24, 25 which are pivotally hinged to the threaded sleeves 22, retract or fold causing the mattress support 14 to lower.

One end of the upper arms 24 is pivotally hinged to the threaded sleeve 22 and the other end is attached, by bolt, welding, or similar means, to the mattress support 14. One end of the lower arms 25 is pivotally hinged to the threaded sleeves 22 and the other end is attached, by bolt, welding, or similar means, to the base 12 of the bed raiser 10. In the preferred embodiment the bed raiser 10 contains a means for automatically locking the motor in place upon deactivating the motor, thus retaining the mattress support 14 in the selected position.

Additionally, one preferred embodiment of the bed raiser is comprised of a pair of pipe guides 30 which serve to stabilize and support the apparatus when in use. The pipe guides 30 are connected to the base 12 and mattress support 14 by bolting, welding, or other similar means.

Therefore, in use the bed raiser 10 can be manipulated by the user himself or an attendant to a desired position. The bed raiser 10 in the "p" position raises the head of a bed to an inclined position. It has been shown that reflux, especially with hiatal hernia patients, can be significantly reduced by inclining the bed while sleeping. The present invention elevates the head of a bed to an inclined position, which effectively improves esophageal acid clearance of a sleeping user and thus reduces the harmful effects of reflux.

The bed raiser 10 is also unique in that it is not a part of the mattress or bed frame which it is designed to raise. This feature allows the present invention to be portable and used with a number of beds at differing times. Thus a user who purchases a new bed or temporarily moves to another residence (as many retired elderly people do) may utilize the present invention with the new or temporary bed. The bed raiser 10 can be fairly easily transported, unlike prior art adjustable beds.

Figure 4:
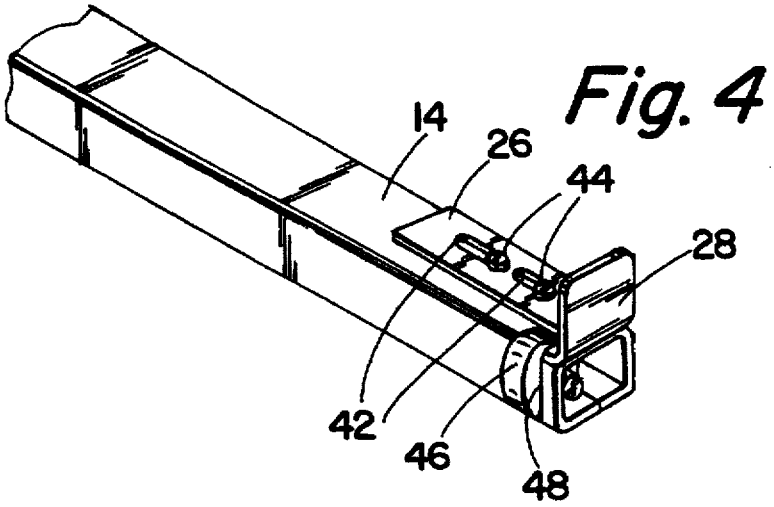
FIG. 4 is a perspective view of the adjustable clamp of the present invention shown in FIG. 1.
Figure 5:
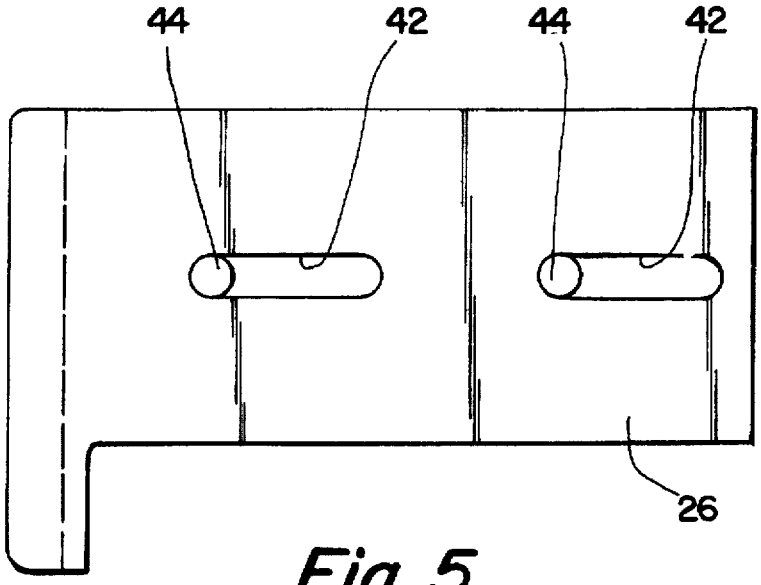
FIG. 5 is a top plan view of an extension component of one embodiment of the present invention.
Figure 6:
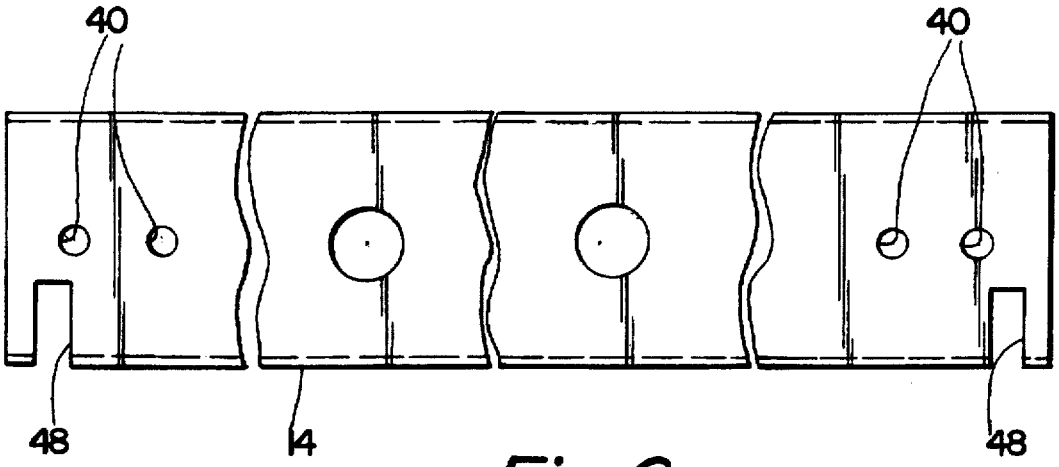
FIG. 6 is a top plan view of the mattress support of the present invention shown in FIG. 1.

Additionally, the adjustability of the mattress support 14 (better depicted by FIG. 4), allows the bed raiser 10 to be used with all sizes of beds. The adjustability of the mattress support 14 by extraction of the extensions 26 may be accomplished by a bolt and groove system FIG. 5 illustrates a top view of an extension 26. Two grooves 42 are cut out of the portion of the extension 26 which overlaps the mattress support 14. FIG. 6 illustrates the top view of the mattress support 14. (note that FIGS. 5 and 6 are not dram proportional to one another). As shown, two holes 40 are cut out of the mattress support 14 which are in alignment with the two grooves 42 in the extension 26. A bolt 44 is placed through the holes 40 of the mattress support 14 and the corresponding grooves 42 of the extensions 26. Thus a user can adjust for differing bed sizes by pulling out or pushing in the extensions 26. Thus, for example, if the extension 26 shown in FIG. 5 is the extension of the left side of the apparatus (left side corresponding to FIG. 1) the bolts 44 in the leftmost position corresponds to the extension 26 completely pushed in, or retracted. If the user pulls or extracts the extension 26 completely out, the bolts 42 would be in the right side of the grooves 42 of FIG. 5.

Figure 7:
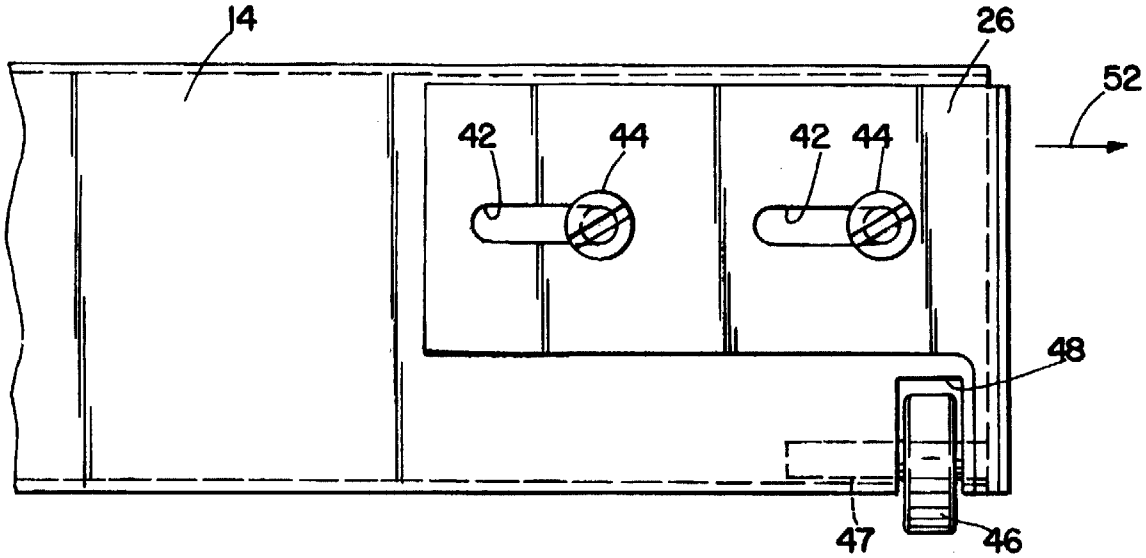
FIG. 7 depicts the top view of the right hand portion of the bed raiser of FIG. 1.

FIG. 7 depicts the top view of the right hand portion of the bed raiser 10 shown in FIG. 1. An extension 26 (depicted in FIG. 5) may be placed onto the mattress support 14 (depicted in FIG. 6), so that the grooves 42 in the extension 26 are placed over the holes 40 in the mattress support 14. Two bolts 44 are then screwed through the grooves 42 and the holes 40. Thus the extension 26 can now be adjusted, by the length of the groove 42, for the particular bed to be raised. For example, in FIG. 7, by pulling out the extension 26 in the direction of the arrow 52, the extension 26 pulls out, the bolts 44 move along the grooves 42, and a wider bed can now be placed onto the bed raiser 10. The extensions 26 have a clamp portion 28 at their ends which serve to maintain the mattress on the mattress support 14.

Figure 8:
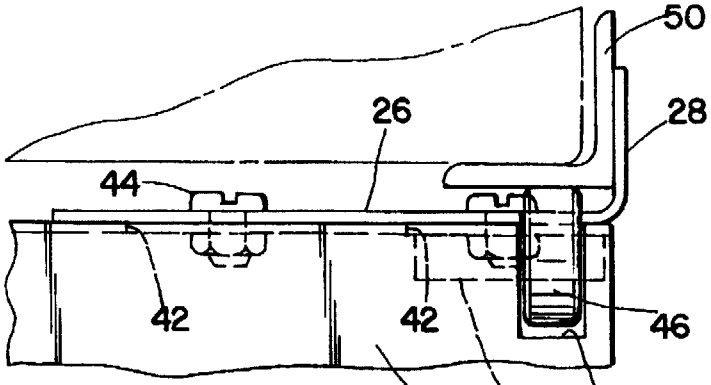
FIG. 8 is a front view of the right hand portion of the bed raiser shown in FIG. 7.

FIG. 8 illustrates the front view of FIG. 7. Additionally, in the preferred embodiment, a roller 46 is placed at each end of the mattress support 14. The rollers 46 are fitted into slots 48 located in the ends of the mattress support 14. The rollers 46 turn on shafts 47 which are attached to, or form a part of, the mattress support 14. The shafts 47 are placed across the slots 48 of the mattress support 14. The bed rail 50, of the bed to be raised, rests on the mattress support 14 and the rollers 46. As the bed is being lifted, the bed rail 50 rolls along the rollers 46 which prevents tipping of the bed raiser 10 during operation.

Figure 9:
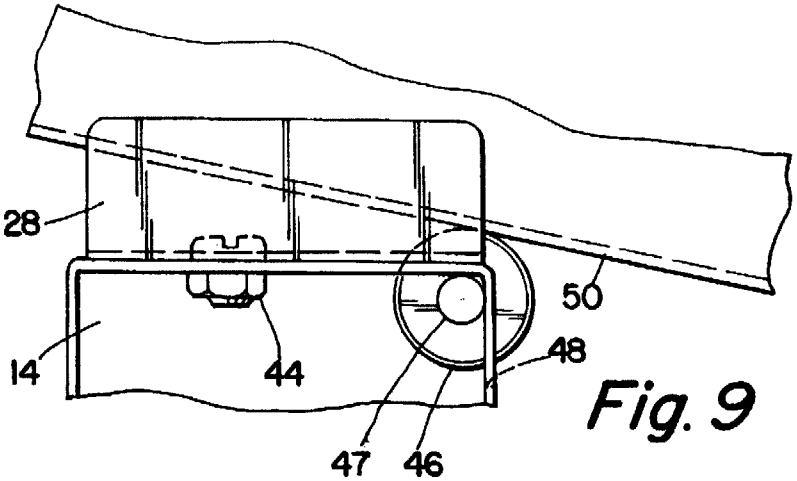
FIG. 9 illustrates left end view of the mattress support of the bed raiser of FIG. 1.

FIG. 9 illustrates the end view of the left end view of the mattress support 14 portion of the bed raiser 10. As the bed raiser 10 is lifting the bed, the bed rail 50 rides along the rollers 46 as the bed is being raised. Again, this prevents the bed raiser 10 from being shifted in position due to the lifting of the bed.

The present invention provides a separable, portable and economical apparatus for raising the head of practically any size bed to an inclined position which reduces the harmful effects of gastroesophageal reflux.

What is claimed is:

1. A bed raiser apparatus, which raises an end of a bed to an incline position, comprising:

a control means;

a motor, electrically connected to said control means;

a mattress support, having a first and second end;

a means for raising and lifting said mattress support;

a power transmission means, wherein said power transmission means transfers the power created by said motor to said means for raising and lifting said mattress support in response to said control means:

a first extension connected to said first end of said mattress support;

a second extension connected to said second end of said mattress support; and wherein said mattress support is adjustable to the size of the bed intended to be raised and lowered by extracting or retracting said first and second extensions.

2. The bed raiser apparatus of claim 1, further comprising:

a base; and a pair of pipe guides attached to said base and said mattress support, which support and stabilize said apparatus.

3. The bed raiser apparatus of claim 1, wherein said mattress support is made adjustable by a groove and bolt system.

4. The bed raiser apparatus of claim 3 further comprising a first end clamp mounted on said first adjustable support; and a second end clamp mounted on said second adjustable support.

5. The bed raiser apparatus of claim 1, wherein said apparatus fits underneath a bed when in a down position.

6. The bed raiser apparatus of claim 5, wherein said apparatus lifts said bed from 0 to 6 inches.

7. A bed raiser apparatus, which raises an end of a bed to an incline position, comprising:

a control means;

a motor, electrically connected to said control means;

a mattress support, having a first and second end;

a means for raising and lifting said mattress support;

a power transmission means, wherein said power transmission means transfers the power created by said motor to said means for raising and lifting said mattress support in response to said control means;

wherein said motor is an electric rotary motor operable in either rotational direction and which further comprises a first output shaft on one side of said motor and a second output shaft on the opposite side of said motor; and wherein said power transmission means comprises: a first universal joint connected to said first output shaft; a second universal joint connected to said second output shaft; a first threaded screw connected to said first universal joint; and a second threaded screw connected to said second universal joint.

8. The bed raiser apparatus of claim 7, further comprising:

a base: and wherein said means for raising and lifting said mattress support comprises:

a first threaded sleeve member threadedly connected to said first threaded screw;

a second threaded sleeve member threadedly connected to said second threaded screw;

a first upper arm, with a first and second end, wherein said first end is hinged to said first threaded sleeve member and said second end is connected to said mattress support;

a second upper arm, with a first and second end, wherein said first end is hinged to said second threaded sleeve member and said second end is connected to said mattress support;

a first lower arm, with a first and second end, wherein said first end is hinged to said first threaded sleeve member and said second end is connected to said base; and a second lower arm, with a first and second end, wherein said first end is hinged to said second threaded sleeve member and said second end is connected to said base.

* * * * *

UNITED STATES PATENT AND TRADEMARK OFFICE

CERTIFICATE OF CORRECTION

PATENT NO. : 5,713,091
DATED : February 3, 1998
INVENTOR(S) : Harold E. Houchin

It is certified that error appears in the above-indentified patent and that said Letters Patent is hereby corrected as shown below:

In column 1, line 10, please delete the word "gastroesophagea/reflux" and replace it with -- gastroesophageal reflux --.

In column 1, line 34, please delete the word "sensing" and replace it with -- serving --.

In column 2, line 20, after the word "to", please insert -- GERD) --.

In column 2, line 52, please delete the word "timber" , and insert --further--.

In column 5, line 38, please delete the word "p" and replace it with -- up --.

In column 5, line 62, please delete the word "dram" and replace it with -- drawn --.

Signed and Sealed this

Fourteenth Day of July, 1998

Bruce Lehman

*Attest:*

BRUCE LEHMAN

*Attesting Officer*

*Commissioner of Patents and Trademarks*